US009879678B2

(12) United States Patent
Fukaya et al.

(10) Patent No.: US 9,879,678 B2
(45) Date of Patent: Jan. 30, 2018

(54) SCROLL COMPRESSOR

(71) Applicant: Johnson Controls-Hitachi Air Conditioning Technology (Hong Kong) Limited, Kowloon Bay KLN (HK)

(72) Inventors: Yoshihiro Fukaya, Tokyo (JP); Takeshi Tsuchiya, Tokyo (JP); Shuji Hasegawa, Tokyo (JP); Koichi Imada, Tokyo (JP); Akihiro Ishikawa, Tokyo (JP)

(73) Assignee: Johnson Controls-Hitachi Air Conditioning Technology (Hong Kong) Limited, Kowloon Bay KLN (HK)

( * ) Notice: Subject to any disclaimer, the term of this patent is extended or adjusted under 35 U.S.C. 154(b) by 178 days.

(21) Appl. No.: 14/769,553

(22) PCT Filed: Mar. 27, 2013

(86) PCT No.: PCT/JP2013/058901
§ 371 (c)(1),
(2) Date: Aug. 21, 2015

(87) PCT Pub. No.: WO2014/155546
PCT Pub. Date: Oct. 2, 2014

(65) Prior Publication Data

US 2016/0003252 A1 Jan. 7, 2016

(51) Int. Cl.
*F01C 1/02* (2006.01)
*F01C 1/063* (2006.01)
(Continued)

(52) U.S. Cl.
CPC ..... *F04C 29/005* (2013.01); *F04C 18/0215* (2013.01); *F04C 23/008* (2013.01);
(Continued)

(58) Field of Classification Search
CPC ..... F04C 18/0215; F04C 27/008; F04C 29/0085; F04C 29/023
(Continued)

(56) References Cited

U.S. PATENT DOCUMENTS 6,318,982 B1 * 11/2001 Fujii ..... F04C 27/005 418/55.1
8,747,014 B2 * 6/2014 Raszkowski ..... F16C 35/063 192/109 R
(Continued)

FOREIGN PATENT DOCUMENTS

JP 2-139387 U 11/1990
JP 2-301688 A 12/1990
(Continued)

OTHER PUBLICATIONS

Extended European Search Report issued in counterpart European Application No. 13880364.8 dated Sep. 28, 2016 (7 pages).
(Continued)

*Primary Examiner* — Mark Laurenzi
*Assistant Examiner* — Deming Wan
(74) *Attorney, Agent, or Firm* — Crowell & Moring LLP

(57) ABSTRACT

An object is to enable suppression of degradation of reliability by supporting a flange portion of a crankshaft with a bearing while downsizing a scroll compressor by reducing the size of the flange portion of the crankshaft. A scroll compressor includes: a fixed scroll fixed to a frame; an orbiting scroll forming a compression chamber by performing an orbital motion with respect to the fixed scroll; an electric motor that drives the orbiting scroll via the crankshaft; and a bearing part provided on the lower side from the flange portion of the crankshaft that rotatably supports a main shaft part of the crankshaft. The scroll compressor furthers has a thrust stopper, provided between the flange
(Continued)

portion and the bearing part, in contact with the flange portion on the upper side and in contact with the bearing part on the lower side. Assuming that the outer diameter of the flange portion 12*d* is φDt and the outer diameter of the thrust stopper is φDs, φDt<φDs holds.

8 Claims, 3 Drawing Sheets

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 29/00*** | (2006.01) |
| ***F04C 23/00*** | (2006.01) |
| ***F04C 29/02*** | (2006.01) |
| ***F04C 18/02*** | (2006.01) |
| ***F04C 27/00*** | (2006.01) |

(52) U.S. Cl.
CPC ..... *F04C 27/008* (2013.01); *F04C 29/0085* (2013.01); *F04C 29/02* (2013.01); *F04C 29/023* (2013.01); *F04C 2240/52* (2013.01)

(58) Field of Classification Search
USPC ..... 418/55.1, 55.5, 55.6; 384/539, 561, 903
See application file for complete search history.

(56) References Cited

U.S. PATENT DOCUMENTS

| | | | | |
|---|---|---|---|---|
| 2005/0226755 | A1* | 10/2005 | Tsuchiya ..... | F04C 27/005 418/55.3 |
| 2010/0329914 | A1* | 12/2010 | Yamada ..... | F04C 18/0215 418/55.6 |
| 2011/0064596 | A1 | 3/2011 | Yanagase et al. | |

FOREIGN PATENT DOCUMENTS

| | | | |
|---|---|---|---|
| JP | 3-210085 | A | 9/1991 |
| JP | 5-18384 | A | 1/1993 |
| JP | 10-148188 | A | 6/1998 |
| JP | 3909415 | B2 | 4/2007 |

OTHER PUBLICATIONS

International Search Report (PCT/ISA/210) dated Jul. 16, 2013, with English translation (four (4) pages).

* cited by examiner

SCROLL COMPRESSOR

TECHNICAL FIELD

The present invention relates to a scroll compressor preferably applicable to compression of refrigerant, air, and other gasses for freezing and air conditioning.

BACKGROUND ART

As a conventional scroll compressor, for example, Japanese Patent No. 3909415 (Patent Literature 1) is known. This Patent Literature 1 has a description "a structure has: a crankshaft coupling an orbiting scroll member to rotational driving means of a drive part; a main shaft support part to support a main shaft part of the crankshaft on the compression chamber side from the rotational driving means; a member for placement of the main shaft support part; and a seal material to separate space forming the back side of the orbiting scroll member, into central space at approximately discharge pressure and outer peripheral space at pressure lower than the pressure of the central space, by pressure. A revolving shaft support part engaged with an eccentric pin part of the crankshaft is provided in the orbiting scroll member. The eccentric pin part is engaged with the revolving shaft support part so as to form a part of the central space in a status where an end surface of the eccentric pin part is opposite to the back face of the orbiting scroll member. Oil supply means to supply lubricating oil to the central space is provided, and almost all the lubricating oil supplied to the central space is returned through the main shaft support part on the opposite side to the compression chamber to a closed vessel bottom. As the main shaft support part, a rolling bearing is used. Further, the outer diameter of the central space separated with the seal material is smaller than the outer diameter of the rolling bearing".

The structure is made to optimize an orbiting scroll pressing force to a fixed scroll while improve bearing reliability, and reduce mechanical sliding loss at a mechanical sliding part between the orbiting scroll and the fixed scroll so as to improve energy efficiency. Further, the structure is made to suppress excessive pressing with the mechanical sliding part so as to improve reliability (see paragraphs 0011 and 0012 of Patent Literature 1).

CITATION LIST

Patent Literature

PTL 1: Japanese Patent No. 3909415

SUMMARY OF INVENTION

Technical Problem

In the Patent Literature 1, to downsize the scroll compressor, it is possible to slim the crankshaft and reduce the size of the orbiting scroll by reducing the size of the flange portion of the crankshaft. However, in the Patent Literature 1, the load of the crankshaft in the vertical direction is supported with the upper surface of an inner ring of the rolling bearing. When the size of the flange portion of the crankshaft is reduced, it might be impossible to support the load of the crankshaft, and by extension, the reliability of the scroll compressor might be lowered.

Accordingly, the present invention has an object to suppress the degradation of reliability by supporting the flange portion of the crankshaft with the bearing while downsizing the scroll compressor by reducing the size of the flange portion of the crankshaft.

Solution to Problem

To solve the above problem, for example, a structure described in claims is adopted. The present application includes plural means to solve the above object. As one example, "A scroll compressor including:

a fixed scroll fixed to a frame;

an orbiting scroll that forms a compression chamber by performing an orbital motion with respect to the fixed scroll;

an electric motor that drives the orbiting scroll via a crankshaft; and a bearing part provided on the lower side from a flange portion of the crankshaft that rotatably supports a main shaft part of the crankshaft, wherein the compressor further has a thrust stopper, provided between the flange portion and the bearing part, in contact with the flange portion on the upper side and in contact with the bearing part on the lower side, and wherein, assuming that an outer diameter of the flange portion 12*d* is $\varphi Dt$ and an outer diameter of the thrust stopper is $\varphi Ds$, $\varphi Dt<\varphi Ds$ holds," is provided.

Advantageous Effects of Invention

According to the present invention, it is possible to suppress the degradation of reliability by supporting the flange portion of the crankshaft with the bearing while downsizing the scroll compressor by reducing the size of the flange portion of the crankshaft.

Other structures and effects of the present invention will be described in detail in the following embodiments.

DESCRIPTION OF EMBODIMENTS

Figure 1:
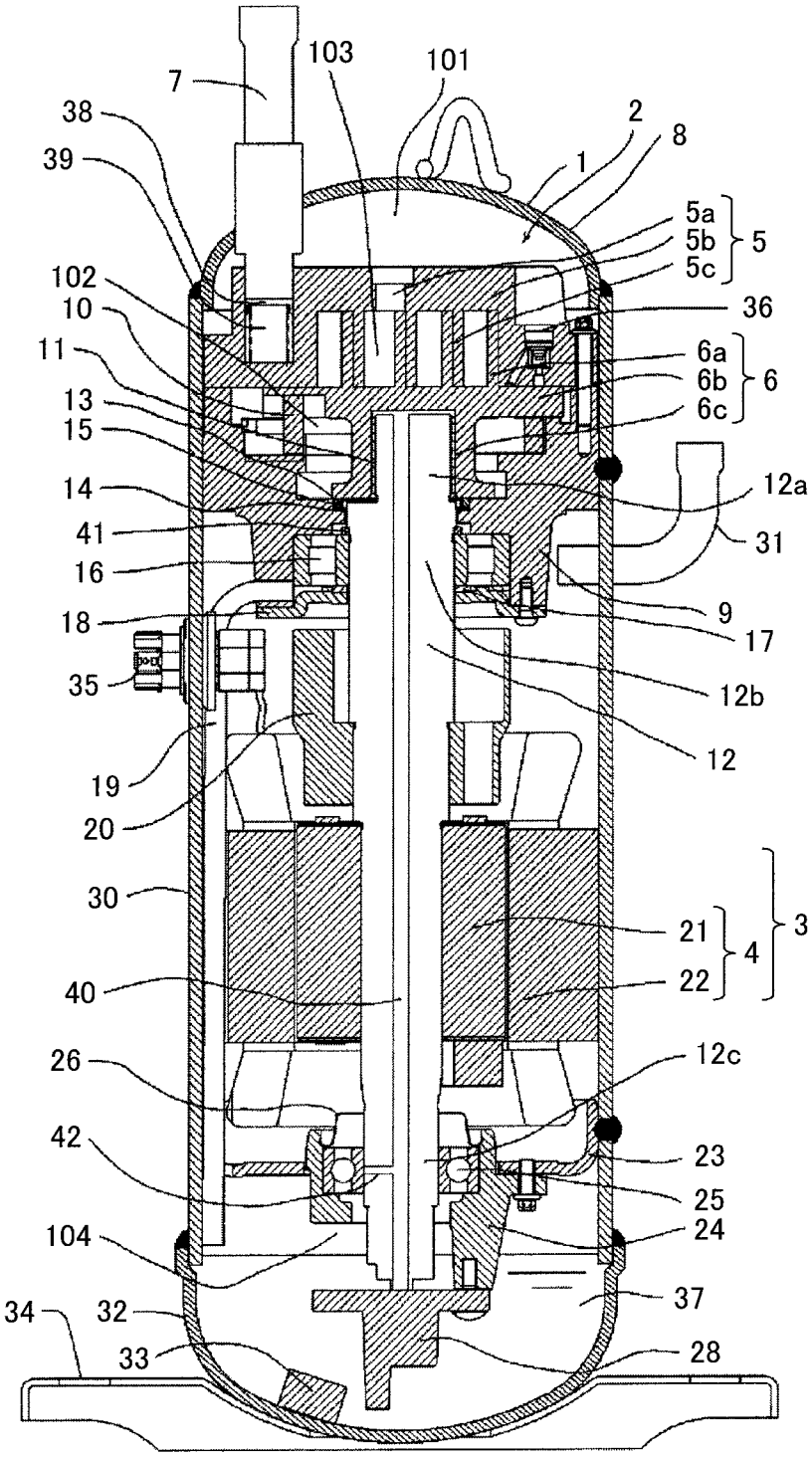
FIG. 1 is a longitudinal cross-sectional diagram of a fluid compressor in a first embodiment.

The present invention relates to a scroll compressor preferably applicable to refrigerant, air and other gasses for freezing and air conditioning. More particularly, the invention relates to a scroll compressor preferable to achieve downsizing while maintaining reliability of a bearing part and compressor efficiency in various purposes. Hereinbelow, plural embodiments of the present invention will be described using the drawings. Note that the same reference numerals in the figures of the respective embodiments denote the same elements or corresponding elements.

First Embodiment

A scroll compressor as a fluid compressor according to a first embodiment of the present invention will be described using FIGS. 1 and 2.

FIG. 1 is a longitudinal cross-sectional diagram of a scroll compressor 1 of the first embodiment. FIG. 2 is an enlarged diagram of a main bearing portion in FIG. 1. As the scroll compressor 1, a compression mechanism part 2 to compress a refrigerant, a driving part 3 to drive the compression mechanism part 2, and a crankshaft 12 connected to both of the driving part 3 and the compression mechanism part 2, are accommodated in a closed vessel 30.

The compression mechanism part 2 has a fixed scroll 5, an orbiting scroll 6 and a frame 9, as basic elements. The frame 9 is fixed to the closed vessel 30, and supports a rolling bearing 16. Further, the frame 9 covers the rolling bearing 16, together with a bearing support 18. A thrust bearing 17 is provided between the bearing support 18 and the rolling bearing 16. It is removably attached to the frame 9 so as to press the rolling bearing 16. The fixed scroll 5 has a fixed side wrap 5*c*, a fixed side plate portion 5*b*, a discharge port 5*a*, and back pressure generating means 36, as basic constituents. It is fixed to the frame 9 with a bolt. The fixed side wrap 5*c* is erected on one side (lower side in FIG. 1) of the fixed side plate portion 5*b*. The orbiting scroll 6 has an orbiting side wrap 6*a*, an orbiting side plate portion 6*b*, and an orbiting scroll bearing portion 6*c*, as basic constituents. The orbiting side wrap 6*a* is erected on one side (upper side in FIG. 1) of the orbiting side plate portion 6*b*. The orbiting scroll bearing portion 6*c* is formed to vertically project to the other side (the opposite side of the orbiting side wrap 6*a*) of the orbiting side plate portion 6*b*. The orbiting scroll 6 is formed by processing the respective constituents from cast metal articles using cast iron or aluminum as material.

In a compression chamber 103, formed by engagement between the fixed scroll 5 and the orbiting scroll 6, the capacity is reduced by an orbital motion of the orbiting scroll 6 and a compression operation is performed. In this compression operation, in accordance with the orbital motion of the orbiting scroll 6, the working fluid is taken from an intake pipe 7, and sucked via an intake port 39 into the compression chamber 103. The sucked working fluid is discharged from the discharge port 5*a* of the fixed scroll 5 through a compression process in the compression chamber 103 to the discharge pressure vessel 101. The discharged working fluid is discharged from the closed vessel 30 via a discharge pipe 31 to the outside. With this configuration, the discharge pressure is maintained in the space within the closed vessel 30. As working fluid to be compressed with the compression mechanism part 2, a global-environmentally friendly high-pressure refrigerant such as R410A or R32 is used.

The driving part 3 to orbit-drive the orbiting scroll 6 is configured with an electric motor 4 having a stator 22 fixed to the closed vessel 30 and a rotor 21 which is provided on the inner peripheral side of the stator 22 and which orbits. Further, an Oldham's coupling 10 is a main part of a rotation prevention mechanism of the orbiting scroll 6. A rolling bearing 25 is a sub bearing to rotatably support a sub shaft part 12*c* of the crankshaft 12. The orbiting scroll bearing portion 6*c* is provided with a sliding bearing 11. A crank pin 12*a* in an upper part of the crankshaft 12 is rotatably supported with the sliding bearing 11.

The crankshaft 12 is configured with the main shaft part 12*b*, the crank pin 12*a*, and the sub shaft part 12*c*, integrally. In the crankshaft 12, a flange portion 12*d*, having a large diameter φDt spreading wider than the crank pin 12*a* to the outer peripheral side, is formed in a lower part of the crank pin 12*a*. A thrust stopper 41, having a diameter φDs greater than the flange portion 12*d*, is attached between the flange portion 12*d* and an inner ring 16*a* of the rolling bearing 16, for positioning of the inner ring 16*a* of the rolling bearing 16 in an axial direction. Note that the thrust stopper 41 may be integrally configured with material the same as that of the flange portion 12*d* of the crankshaft 12. With this configuration, it is possible to reduce the number of parts.

The main shaft part 12*b* and the sub shaft part 12*c* are co-axially formed, to form the main shaft part. Further, an oil supply pump 28 is attached to a lower end of the crankshaft 12. The rolling bearing 16 of the main bearing and the rolling bearing 25 of the sub bearing respectively rotatably support the main shaft part 12*b* and the sub shaft part 12*c* of the crankshaft 12. In the orbiting scroll bearing portion 6*c*, the sliding bearing 11 is press-fitted in the inner diameter. It is provided on the back face side of the orbiting scroll 6 so as to support the crank pin 12*a* of the crankshaft 12 movably in a thrust direction as a rotation axial direction, and rotatably support the crank pin.

The Oldham's coupling 10 is provided on the back face side of the orbiting side plate portion 6*b* of the orbiting scroll 6. One of two orthogonal pairs of keys formed in the Oldham's coupling 10 slides in a key groove as a receiving portion of the Oldham's coupling 10 formed in the frame 9. The other pair slides in a key groove formed on the back face side of the orbiting side wrap 6*a*. With this configuration, the orbiting scroll 6 performs an orbital motion without rotation with respect to the fixed scroll 5 within a surface vertical to an axial direction in which the orbiting side wrap 6*a* is erected.

In the compression mechanism part 2, when the crank pin 12*a* eccentrically rotates by rotation of the crankshaft 12 connected to the electric motor 4, the orbiting scroll 6 performs an orbital motion without rotation, with the rotation preventing mechanism of the Oldham's coupling 10, with respect to the fixed scroll 5. With this configuration, the refrigerant gas is sucked via the intake pipe 7 and the intake port 39 into the compression chamber 103 formed with the fixed side wrap 5*c* and the orbiting side wrap 6*a*. In the compression chamber 103, by the orbital motion of the orbiting scroll 6, the decrease in the capacity in accordance with movement toward the central part compresses the refrigerant gas. The compressed gas is discharged from the discharge port 5*a* to the discharge pressure space 101. The gas discharged to the discharge pressure space 101 circulates around the compression mechanism part 2 and the electric motor 4, then is discharged from the discharge pipe 31 to the outside of the compressor.

Note that the fixed scroll 5 is provided with the back pressure generating means 36 to maintain the pressure in a back pressure chamber 102 at an intermediate level (intermediate pressure) between suction pressure and discharge pressure. The back pressure chamber 102 formed on the back face side of the orbiting scroll 6 is space surrounded by the orbiting scroll 6, the frame 9 and the fixed scroll 5. The sealing member 13 partitions the pressure in the chamber into the discharge pressure on the inner peripheral side and the intermediate pressure on the outer peripheral side.

The rolling bearing 16 is provided on the upper side of the electric motor 4. The rolling bearing 25 forming a main part of the sub bearing portion 104 is provided on the lower side of the electric motor 4. The rolling bearing 16 and the roiling bearing 25 support the main shaft part on the both sides of the electric motor 4. In the present embodiment, as the main shaft part is supported with the rolling bearing 16 and the rolling bearing 25 on the both sides of the electric motor 4, it is possible to prevent inclination of the main shaft part of the crankshaft 12 while suppressing power loss of the rolling bearing 16.

The oil supply pump 20 is a positive displacement pump provided at a lower end of the crankshaft 12. It forcibly supplies lubricating oil stored in an oil sump 37 through the inside of an oil supply hole 40 to the upper part. With this configuration, lubrication is performed by supply of the lubricating oil via the rolling bearing 25 and the orbiting scroll bearing portion 6*c* to the rolling hearing 16. Note that the oil supplied to the oil supply hole 40 is also supplied to a sliding portion between the orbiting scroll 6 and the fixed scroll 5. The oil supply hole 40 is longitudinally formed coaxially with the axial center of the crankshaft 12. The oil supply hole 40 is provided with a horizontal oil supply hole 42 to supply the oil to the rolling bearing 25. The oil is supplied by appropriate amount to each bearing.

The rolling bearing 16 is configured with an inner ring 16*a*, an outer ring 16*b* provided outside the inner ring, and plural rolling bodies provided therebetween. Note that when the thrust stopper 41 is omitted in FIG. 2, when the rolling bearing 16 is assembled, the inner ring 16*a* is inserted from the lower side in FIG. 2 with respect to the crankshaft 12, and positioned with the flange portion 12*d*. Then the inner ring 16*a* is press-fitted in the crankshaft 12 and fixed. Since the direction after the assembly is as shown in FIG. 2, an upper surface of the inner ring 16*a* of the rolling bearing 16 receives load in the vertical direction from the flange portion 12*d* of the crankshaft 12. Accordingly, in this case, it is not possible to support the load of the crankshaft 12 if an inner diameter φDt of the flange portion 12*d* is not greater than an inner diameter φDb of the inner ring 16*a*.

Since it is possible to reduce the inner diameter of the crankshaft 12 and reduce the size of the orbiting scroll 6 by reducing the inner diameter φDt of the flange portion 12*d*, it is possible to downsize the scroll compressor 1. However, when the structure lacks the thrust stopper 41, since the contact area between the upper surface of the inner ring 16*a* and the flange portion 12*d* is reduced, the load of the crankshaft 12 cannot be supported with the upper surface of the inner ring 16*a*. This might lower the reliability of the scroll compressor 1. Note that in the present embodiment, the rolling bearing 16 is used as a main bearing. When a sliding bearing is adopted as the main bearing, a similar problem occurs.

Accordingly, in the present embodiment, the structure has: the flange portion 12*d* of the crankshaft 12; the bearing part (rolling bearing 16) provided on the lower side from the flange portion 12*d* to rotatably support the main shaft part of the crankshaft 12; and the thrust stopper 41 provided between the flange portion 12*d* and the bearing part (rolling bearing 16), in contact with the flange portion 12*d* on the upper side and in contact with the bearing part (rolling bearing 16) on the lower side. The load of the crankshaft 12 is applied to the upper surface of the thrust stopper 41. With this configuration, the load of the crankshaft 12 is infallibly supported with the surface-contact between the lower surface of the thrust stopper 41 and the upper surface of the flange portion 12*d*.

Note that it is necessary that φDt<φDs holds as the relation between the outer diameter φDt of the flange portion 12*d* and the outer diameter φDs of the thrust stopper 41. Further, since the position of the outer peripheral side end of the thrust stopper 41 with respect to the inner peripheral side end of the upper surface of the bearing part is on the outer peripheral side, the surface contact is possible between the upper surface of the bearing part and the lower surface of the thrust stopper 41. It is possible to improve the reliability of the above-described support of the load of the crankshaft 12.

Figure 2:
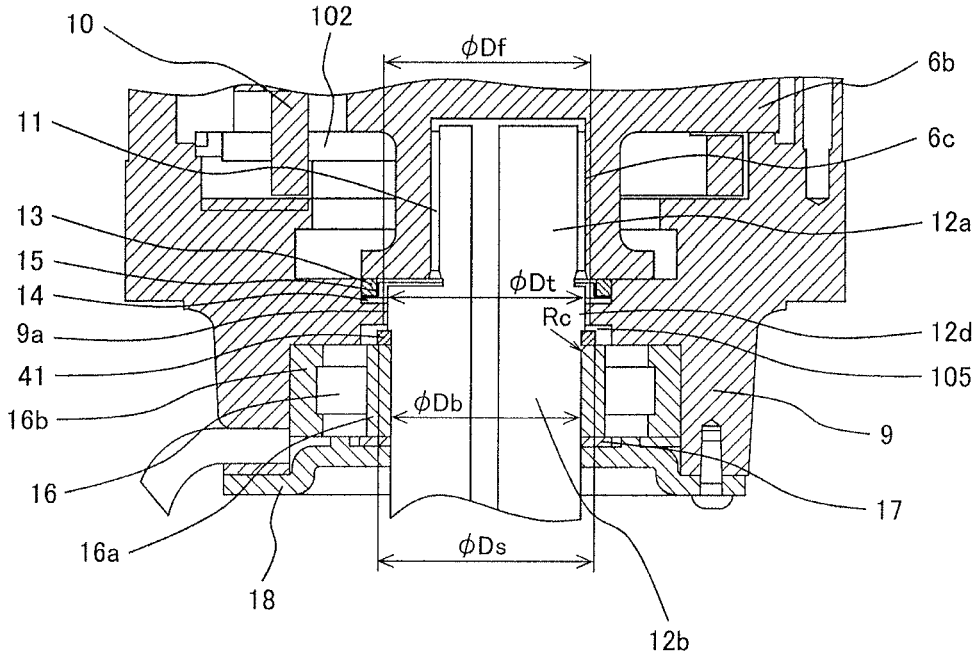
FIG. 2 is an enlarged diagram of a main bearing portion in the first embodiment.

Note that in FIG. 2, in the case of the rolling bearing, a chamfered part having a chamfer dimension Rc is provided in the upper part of the inner ring 16*a* on the side in contact with the crankshaft 12, i.e., in the upper part of the inner ring 16*a* on the inner diameter side. In this example, the chamfer dimension is set to the same radius Rc while it is not limited to this dimension. With this configuration, it is possible to improve operability when the inner ring 16*a* is assembled in the crankshaft 12. In this case, assuming that the inner diameter of the bearing part (the inner diameter of the inner ring 16*a* in FIG. 2) is φDb, it is necessary that φDb+Rc×2<φDs holds. In FIG. 2, Rc is the radius of the chamfer part. However, when it does not have a round shape, Rc is a minimum distance from the inner peripheral side end in the flat upper surface of the bearing part (inner ring 16*a*) to the inner peripheral surface of the bearing part (inner ring 16*a*) in contact with the main shaft part 12*b*. When this relation is satisfied, the surface contact is possible between the upper surface of the bearing part (inner ring 16*a*) and the lower surface of the thrust stopper 41.

When the frame 9 has a groove for placement of the sealing member 13 and the inner diameter of the surface of the frame groove for placement of the sealing member opposite to the flange portion 12*d* of the crankshaft 12 is φDf, it is necessary that φDf<φDs holds. With this configuration, the outer diameter φDs of the thrust stopper 41 is engaged with the inner diameter φDf of the frame. When the compressor is assembled, even in an upside-down status, it is possible to prevent fall of the crankshaft.

In this manner, it is possible to perform positioning of the inner ring 16*a* of the rolling bearing 16 in the axial direction upon attachment to the crankshaft 12 with the thrust stopper 41. Accordingly, it is possible to improve working efficiency. Further, as described above, even when the inner diameter of the flange portion 12*d* is reduced, it is possible to support the crankshaft 12 with the thrust stopper 41. It is possible to improve the reliability while downsize the scroll compressor 1. Further, assuming that φDt≤φDb+Rc×2 holds as the relation among the outer diameter φDt of the flange portion 12*d*, the outer diameter φDs of the thrust stopper 41 and the chamfer diameter Rc, it is possible to support the crankshaft 12 with the thrust stopper 41 even when downsizing is achieved by reducing the outer diameter of the flange portion to have an area smaller than the flat surface part at the upper end of the inner ring of the bearing.

Figure 3:
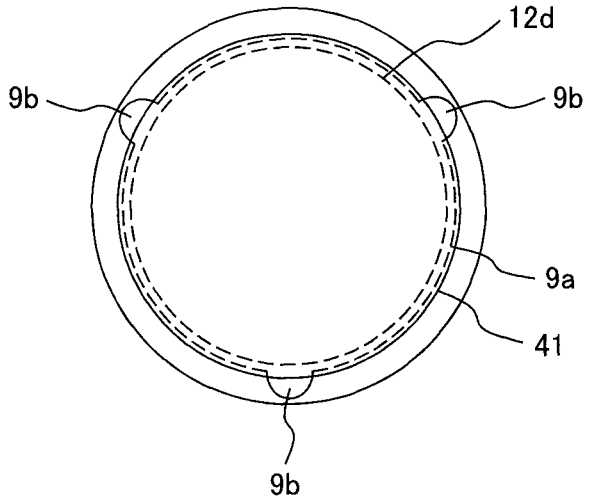
FIG. 3 illustrates a shape of a seal member placement portion of a frame in the first embodiment.

FIG. 3 illustrates the seal member placement portion 9*a* of the frame 9 viewed from the orbiting scroll 6 side. In the present embodiment, since the thrust stopper 41 is provided on the outer peripheral side from the seal member placement portion 9*a*, there is difficulty supply of the lubricating oil from the sliding bearing 11 through an oil supply passage between the seal member placement portion 9*a* and the flange portion 12*d* to the rolling bearing 16. Accordingly, by providing the seal member placement portion 9*a* with one or plural oil supply paths 9*b* connecting the sealing member 13 placement side with the rolling bearing 16 side, it is possible to efficiently supply the oil from the sliding bearing 11 to the rolling bearing 16. Further, it is possible to more effectively perform cooling of the rolling bearing 16. That is, the oil supply path 9 is formed in the frame 9 (seal member placement portion 9*a*) on the further outer peripheral side from the outer peripheral end of the thrust stopper 41.

Further, by setting a clearance 105 in the axial direction of the groove formed between the frame 9 and the thrust stopper 41 to a value smaller than the thickness of the thrust bearing 17, there is no possibility that the thrust bearing 17 falls from the cover 18 even when the compression mechanism part 2 is set upside down. With this configuration, when the scroll compressor 1 is assembled, it is possible to attach all the parts such as the rolling bearing 16, the crankshaft 12, and the cover 18 to the frame 9 from the same direction (from the compressor lower side) while the frame 9 is in upside-down status. It is possible to improve the assembly efficiency of the scroll compressor 1.

Second Embodiment

Figure 4:
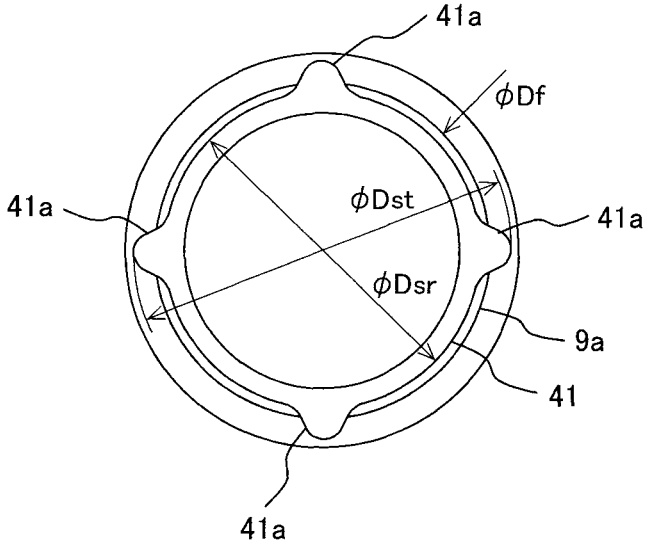
FIG. 4 illustrates a shape of a thrust stopper in a second embodiment.

FIG. 4 illustrates the shape of the thrust stopper 41 and the seal member placement portion 9*a* of the frame 9 according to a second embodiment of the present invention. The explanations of constituent elements having the same functions as those of the elements having the same reference numerals in already described FIGS. 1 and 2 will be omitted.

In the present embodiment, plural claw portions 41*a* are provided on the outer peripheral side of the thrust stopper 41. Assuming that the outer diameter of the ring part of the thrust stopper 41 is φDsr, and the outer diameter dimension of the claw portion 41*a* is φDst, the relation φDsr<φDf<φDst is satisfied.

With the above configuration, it is possible to ensure an oil supply path to the rolling bearing 16 even when the oil supply path 9*b* is not provided in the frame 9. It is possible to attain the same effect as that attained in the first embodiment while suppressing increment in the production cost by forming the thrust stopper 41 with a member different from that of the crankshaft 12 by thin plate presswork.

Particularly, in recent years, the global warming is a serious issue. In the field of air conditioning industry, transit to refrigerants with small global warming coefficients is studied. The use of R32 which is a refrigerant having a small global warming coefficient attracts attention. However, when the refrigerant R32 is used, the temperature rise of compressed refrigerant is greater in comparison with the conventional refrigerant. The viscosity of freezing machine oil upon actual operating is higher. According to the first and second embodiments, even when a single refrigerant or 70% of the refrigerant R32 is adopted in the freezing cycle, it is possible to maintain the small diameter part and further to sufficiently ensure an oil supply path. Further, it is possible to ensure cooling means for the sliding part of the compressor mechanism, more particularly the bearing part. It is possible to improve the bearing reliability.

REFERENCE SIGNS LIST

1 . . . scroll compressor, 2 . . . compression mechanism part, 3 . . . driving part, 4 . . . electric motor, 5 . . . fixed scroll, 5*a* . . . discharge port, 5*b* . . . fixed side plate portion, 5*c* . . . fixed side wrap, 6 . . . orbiting scroll, 6*a* . . . orbiting side wrap, 6*b* . . . orbiting side plate portion, 6*c* . . . orbiting scroll bearing portion, 7 . . . intake pipe, 9 . . . frame, 9*a* . . . seal member placement portion, 9*b* . . . oil supply path, 10 . . . Oldham's coupling, 11 . . . sliding bearing, 12 . . . crankshaft, 12*a* . . . crank pin, 12*b* . . . main shaft part, 12*c* . . . sub shaft part, 12*d* . . . flange portion, 13 . . . sealing member, 16 . . . rolling bearing, 16*a* . . . inner ring, 16*b* . . . outer ring, 17 . . . thrust bearing, 18 . . . hearing support, 21 . . . rotor, 22 . . . stator, 23 . . . lower frame, 24 . . . housing, 25 . . . rolling bearing, 28 . . . oil supply pump, 30 . . . closed vessel, 37 . . . oil sump, 39 . . . intake port, 40 . . . oil supply hole, 41 . . . thrust stopper, 41*a* . . . claw portion, 42 . . . horizontal oil supply hole, 43 . . . oil reservoir space, 44 . . . magnet, 101 . . . discharge pressure space, 102 . . . orbiting scroll back pressure chamber, 103 . . . compression chamber, 104 . . . sub bearing portion, 105 . . . axial clearance between the frame and the thrust stopper.

The invention claimed is:

1. A scroll compressor comprising:

a fixed scroll fixed to a frame;

an orbiting scroll that forms a compression chamber by performing an orbital motion with respect to the fixed scroll;

an electric motor that drives the orbiting scroll via a crankshaft; and a bearing part provided on a lower side from a flange portion of the crankshaft that rotatably supports a main shaft part of the crankshaft, wherein the compressor further has a thrust stopper, provided between the flange portion of the crankshaft and the bearing part, in contact with the flange portion of the crankshaft on the upper side and in contact with the bearing part on the lower side, wherein a clearance in an axial direction is formed between a lower surface of a seal member placement portion of the frame and an upper surface of the thrust stopper, and wherein, assuming that an outer diameter of the flange portion of the crankshaft is φDt and an outer diameter of the thrust stopper is φDs, φDt<φDs holds.

2. The scroll compressor according to claim 1, wherein the thrust stopper is integrally configured with material the same as that of the flange portion of the crankshaft.

3. The scroll compressor according to claim 1, wherein the positon of an outer peripheral side end of the thrust stopper is on the outer peripheral side with respect to an inner peripheral side end of an upper surface of the bearing part.

4. The scroll compressor according to claim 1, wherein the bearing part is an inner ring of a rolling bearing, and wherein when a chamfered part is provided in an upper part of the inner ring of the rolling bearing on the inner diameter side, assuming that an inner diameter of the inner ring is φDb and a minimum distance in radial direction from an inner peripheral side end in a flat upper surface of the inner ring to an inner peripheral surface facing a main shaft part of the crankshaft is Rc, φDb+Rc×2<φDs holds.

5. The scroll compressor according to claim 4, wherein the clearance in the axial direction is a groove formed with the frame.

6. The scroll compressor according to claim 5, further comprising a thrust bearing provided between a bearing support and the rolling bearing, wherein the thrust bearing is to support load in a thrust direction of the crankshaft.

7. The scroll compressor according to claim 1, wherein an oil supply path for oil supply from an oil sump in a closed vessel to an orbiting bearing is provided inside the crankshaft, and oil supply to the bearing part is performed via the orbiting bearing, and wherein a single or a plurality of oil supply paths to connect a sealing member placement side to the bearing part are provided on the inner diameter side of a surface of a groove of the frame, where the sealing member is placed, opposite to the flange portion of the crankshaft.

8. The scroll compressor according to claim 1, wherein an oil supply path for oil supply from an oil sump in a closed vessel to an orbiting bearing is provided inside the crankshaft, and oil supply to the bearing part is performed via the orbiting bearing, and wherein when a plurality of claw portions are provided on the outer peripheral side of the thrust stopper, and assuming that an inner diameter of the seal member placement portion of the frame is φDf, an outer diameter of a ring of the thrust stopper is φDsr, and an outer diameter dimension of the claw portion is φDst, $\varphi Dsr<\varphi Df<\varphi Dst$ holds.

* * * * *